US007533598B1

(12) United States Patent
Murphy

(10) Patent No.: US 7,533,598 B1
(45) Date of Patent: May 19, 2009

(54) SHELL STRIPPER ASSEMBLY

(75) Inventor: Randall S. Murphy, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 338 days.

(21) Appl. No.: 11/368,942

(22) Filed: Mar. 6, 2006

Related U.S. Application Data

(60) Provisional application No. 60/664,847, filed on Mar. 24, 2005.

(51) Int. Cl.
*F41A 9/00* (2006.01)

(52) U.S. Cl. ..... 89/33.1; 89/33.01; 89/33.02; 89/33.03; 42/14; 42/17; 42/18

(58) Field of Classification Search ..... 89/33.1, 89/33.01, 33.02, 33.03; 42/14, 17, 18
See application file for complete search history.

(56) References Cited

U.S. PATENT DOCUMENTS

| | | | | |
|---|---|---|---|---|
| 1,007,911 | A | 11/1911 | Björgum | |
| 1,525,067 | A | 2/1925 | Browning | |
| 1,625,994 | A | 4/1927 | Gorton | |
| 1,898,670 | A * | 2/1933 | Laudensack | 42/18 |
| 2,073,632 | A | 3/1937 | Green | |
| 2,418,428 | A | 4/1947 | Rundquist | |
| 2,453,977 | A | 11/1948 | Eames | |
| 2,499,583 | A * | 3/1950 | Henckel | 89/33.2 |
| 2,603,130 | A | 7/1952 | Bonkemeyer | |
| 3,080,793 | A | 3/1963 | Montana | |
| 3,344,712 | A | 10/1967 | Colby | |
| 3,455,204 | A | 7/1969 | Stoner | |
| 3,866,513 | A | 2/1975 | Hornfeck et al. | |
| 4,527,459 | A * | 7/1985 | Childers | 89/161 |
| H211 | H | 2/1987 | Vanderbeck | |
| 4,744,164 | A | 5/1988 | Rieger | |
| 4,942,802 | A * | 7/1990 | Stoner | 89/191.01 |
| 6,135,005 | A * | 10/2000 | Dobbins | 89/1.41 |
| 6,389,947 | B1 * | 5/2002 | Murello | 89/33.1 |
| 6,397,721 | B1 * | 6/2002 | Murello | 89/33.1 |
| 6,415,701 | B1 * | 7/2002 | Dobbins | 89/1.41 |
| 6,739,082 | B2 * | 5/2004 | Christensen | 42/6 |
| 6,898,888 | B2 * | 5/2005 | Greenhut | 42/18 |
| 2004/0200110 | A1 * | 10/2004 | Greenhut | 42/18 |

FOREIGN PATENT DOCUMENTS

| | | |
|---|---|---|
| DE | 453 659 | 12/1927 |
| DE | 33 42 058 | 3/1985 |
| DE | 33 42 058 C1 | 3/1985 |
| GB | 485 560 | 5/1938 |

* cited by examiner

*Primary Examiner*—Michelle Clement
(74) *Attorney, Agent, or Firm*—Womble Carlyle Sandridge & Rice PLLC.

(57) ABSTRACT

A shell stripper assembly includes a shell stripper, a stripper guide, a stripper guide plate, and a magazine insert. The shell stripper strips the top round from the firearm magazine so that it can be picked up by the firearm breech bolt. The shell stripper slides between guide rails of the stripper guide, and its motion is controlled by the stripper guide plate.

29 Claims, 17 Drawing Sheets

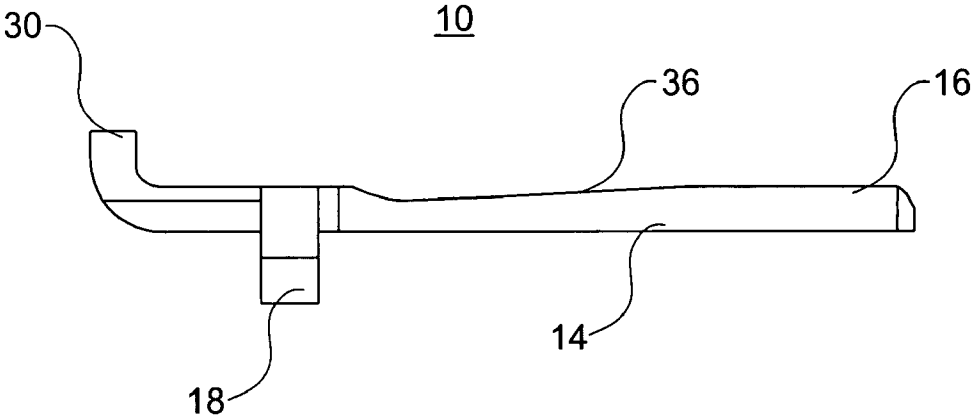
FIG. 2D
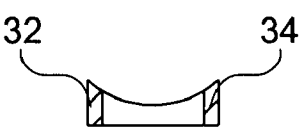
FIG. 2F
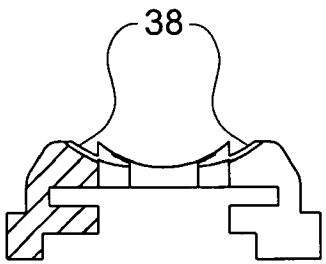
FIG. 2E
FIG. 2C
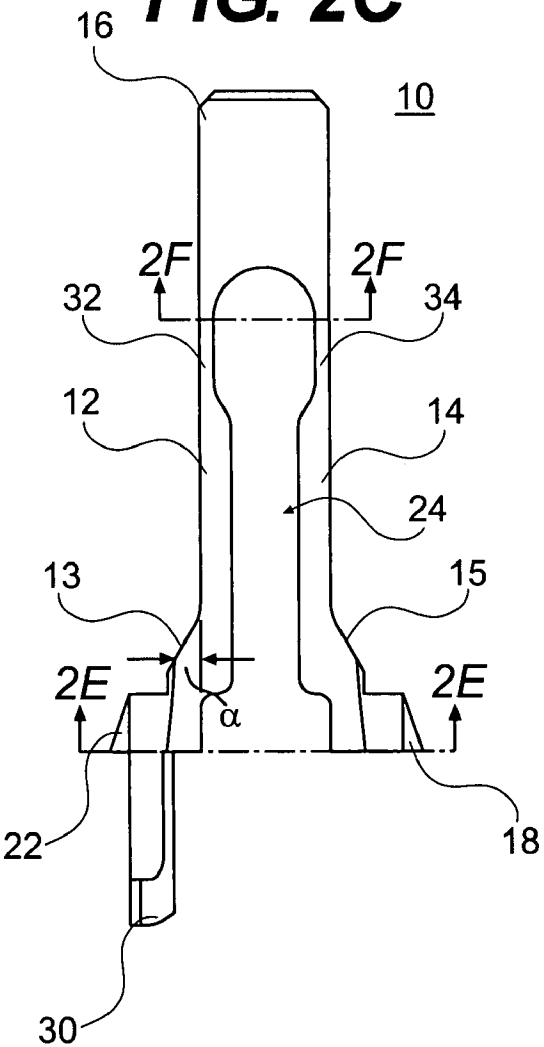

SHELL STRIPPER ASSEMBLY

RELATED APPLICATION

This application claims the benefit of U.S. Provisional Application No. 60/664,847, filed Mar. 24, 2005, entitled "SHELL STRIPPER ASSEMBLY FOR FIREARM," the entire contents of which are hereby incorporated by reference as if presented herein.

BACKGROUND

1. Technical Field

The technical field is related to feeding mechanisms for firearms which strip a round from a magazine and feed the round into a chamber of a firearm.

2. Related Art

Conventional firearms generally include a bolt assembly that both strips the top round from a magazine and then seats the round in the chamber of the firearm. Reliability of this action may suffer, however, in cases such as where the breech bolt diameter is relatively large. Because the breech bolt is typically cylindrical, a large breech bolt diameter means that only a relatively small forward area of the breech bolt will be available to reach into the magazine well and strip the top round from the magazine. In addition, such larger breech bolt diameters typically require a correspondingly larger opening in the top of the magazine to enable the breach bolt to reach in and strip the round from the magazine for loading. These factors may impose undesirable dimensional constraints in designing the firearm.

SUMMARY

According to one embodiment of the present invention, a shell stripper assembly comprises a shell stripper having a body including a first leg, a second leg joined to the first leg at a nose portion, and a first tab extending from the first leg. The shell stripper assembly can also include a stripper guide having a first guide rail and a second guide rail, a stripper guide plate, and a magazine insert. The shell stripper body can be sized to be received between the first and second guide rails, while the shell stripper assembly is adapted to cooperate with an action mechanism within a firearm, such as a rifle, shotgun or handgun, to strip rounds from a magazine of the firearm. The shell stripper further can be provided with an engagement surface that is adapted to efficiently and reliably engage rounds in the magazine. The use of the shell stripper to strip rounds from the magazine thus can minimize or eliminate the requirement for the breech bolt to strip rounds from the magazine. The breech bolt diameter may therefore be minimized as a determining factor in the size or shape of the magazine and/or the magazine well. In addition, the magazine insert can support the magazine of the firearm at a non-zero angle so as to place the top round in the magazine in an orientation to enable the round to be easily and reliably engaged and lifted out of the magazine into a position to be picked up by the breech bolt during closing of the action of the firearm.

According to a second aspect of the present invention, a firearm having the shell stripper assembly of the present invention generally comprises a receiver or frame with a barrel operably connected thereto, a chamber disposed at the rear end of the barrel, and a magazine for supplying rounds of ammunition to the chamber. The firearm further includes an axially translatable bolt that is engageable with the firearm chamber and a firearm action mechanism. The shell stripper assembly of the present invention further generally will be mounted within the receiver of the firearm and will cooperate with the action mechanism to strip fired cartridge casings from the magazine and then seat additional rounds successively within the chamber.

According to a third aspect of the present invention, a method of operating a firearm is provided, comprising returning or closing the action of the firearm after firing, causing the shell stripper and breech bolt forward to be moved forward. During forward motion of the breech bolt, the shell stripper removes or strips a round from the magazine and places it in a position where it can be loaded into the chamber. After firing, the firearm action is opened, during which the shell stripper and breech bolt are moved rearwardly, whereupon the spent cartridge or shell is removed from the chamber.

Other aspects, features, and details of embodiments of the present invention can be more completely understood by reference to the following detailed description of preferred embodiments, taken in conjunction with the drawings figures and from the appended claims.

According to common practice, the various features of the drawings discussed below are not necessarily drawn to scale. Dimensions of various features and elements in the drawings may be expanded or reduced to more clearly illustrate the embodiments of the invention.

BRIEF DESCRIPTION OF THE DRAWING FIGURES

FIG. 2C is a top plan view of the shell stripper.

FIG. 2D is a side elevational view of the shell stripper.

FIG. 2E is a section view taken on line 2E-2E in FIG. 2C.

FIG. 2F is a section view taken on line 2F-2F in FIG. 2C.

DETAILED DESCRIPTION

The shell stripper assembly according to the present embodiments generally relates to a feeding mechanism for stripping and/or feeding the top round of ammunition being fed from a magazine into the chamber of a firearm, such as a rifle, shotgun or other long gun, or a handgun. The firearm further can be, for example, a gas actuated, inertia actuated, semiautomatic, pump action, bolt action, or other type of firearm.

Figure 1:
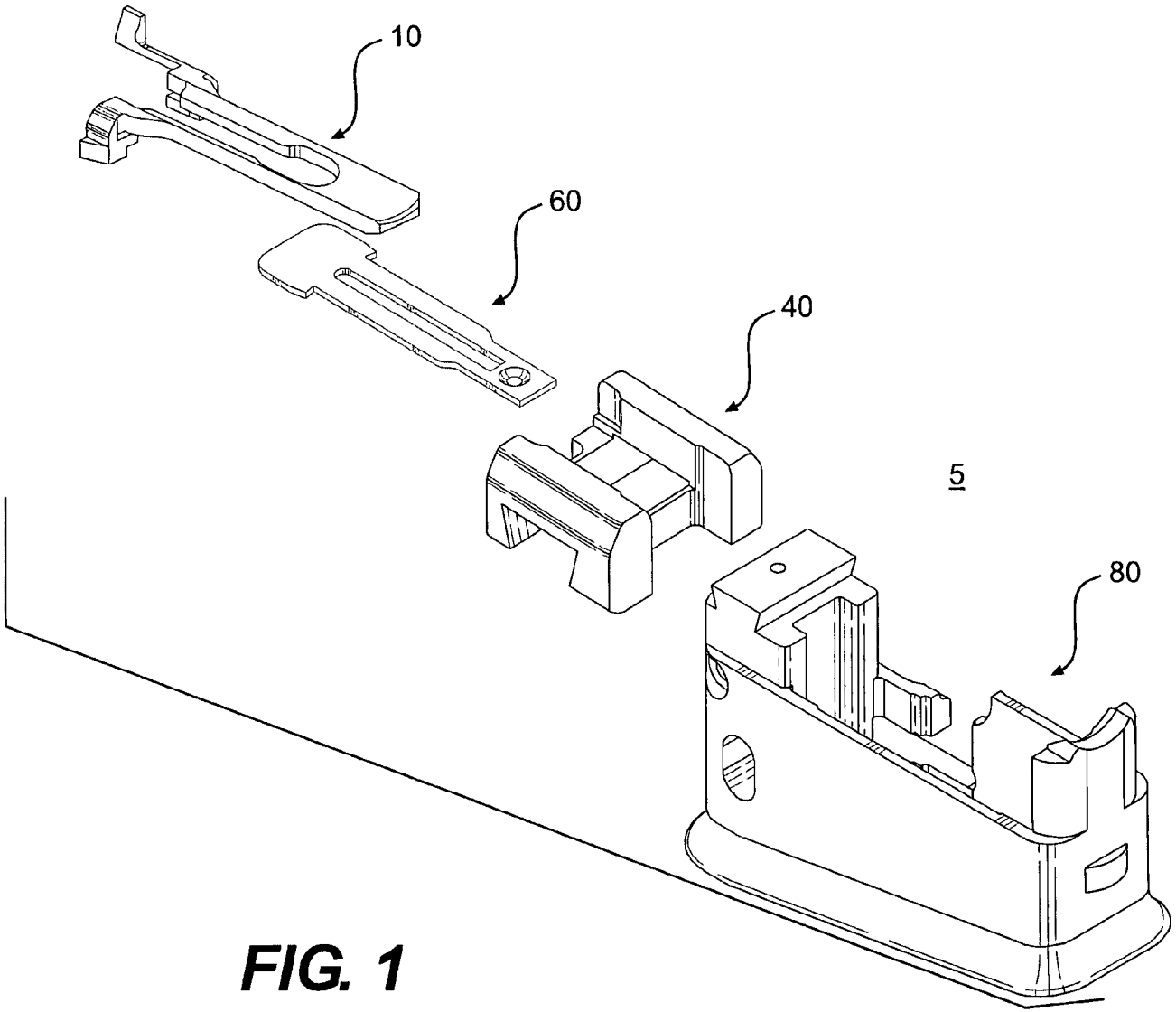
FIG. 1 is an exploded perspective view of a shell stripper assembly according to a first embodiment of the invention.

Referring now to the drawings in which like numerals indicate like parts throughout the several views, FIG. 1 is an exploded perspective view of the individual components of a first example embodiment of a shell stripper assembly 5 according to the principles of the present invention. The shell stripper assembly 5 includes a shell stripper 10, a stripper guide 40, a stripper guide plate 60 and a magazine insert 80. Each of the components of the shell stripper assembly 5 are discussed in further detail below, followed by a discussion of their functions within an exemplary firearm.

Figure 2A:
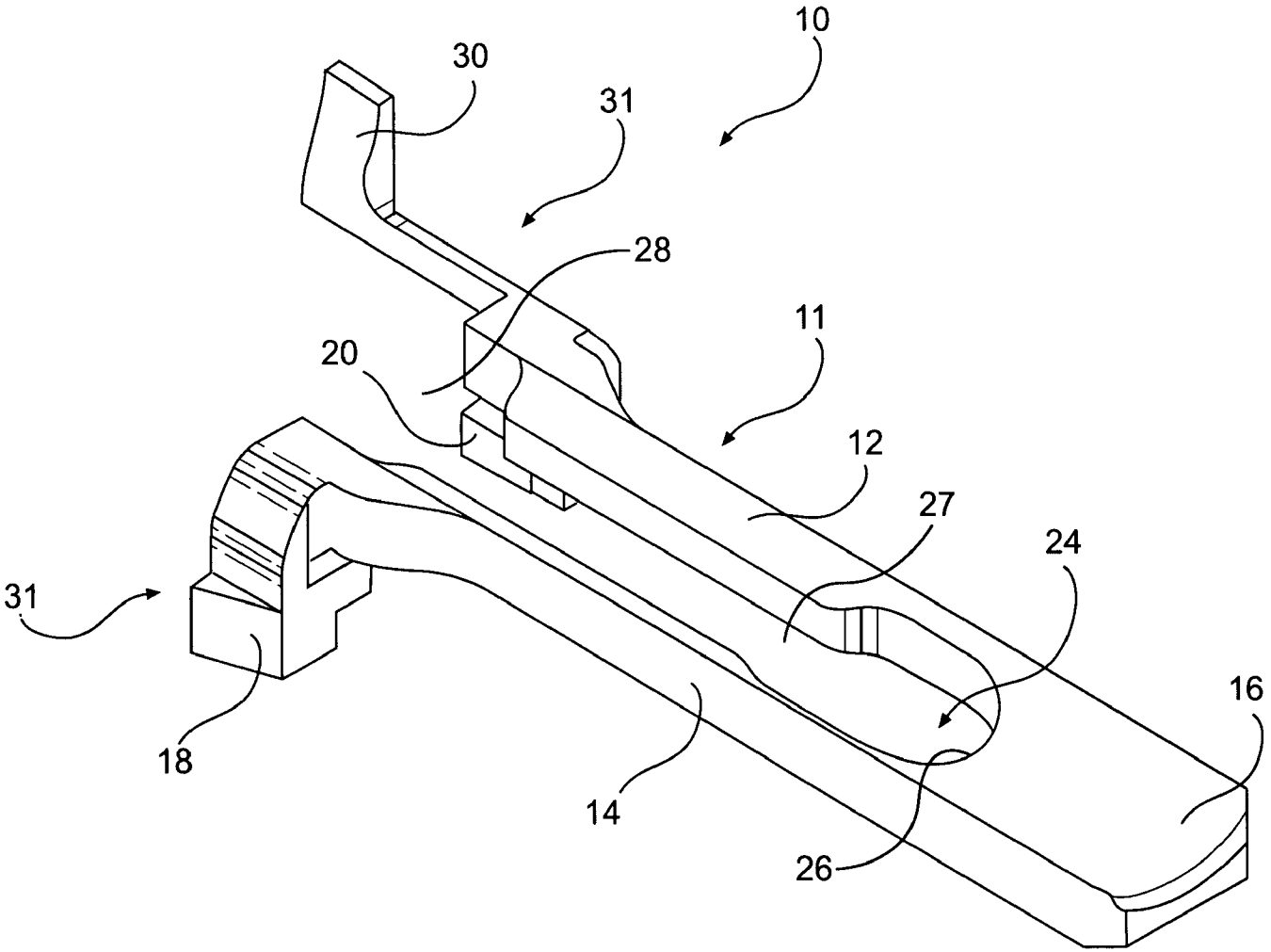
FIG. 2A is a front perspective view of a shell stripper according to the first embodiment.
Figure 2B:
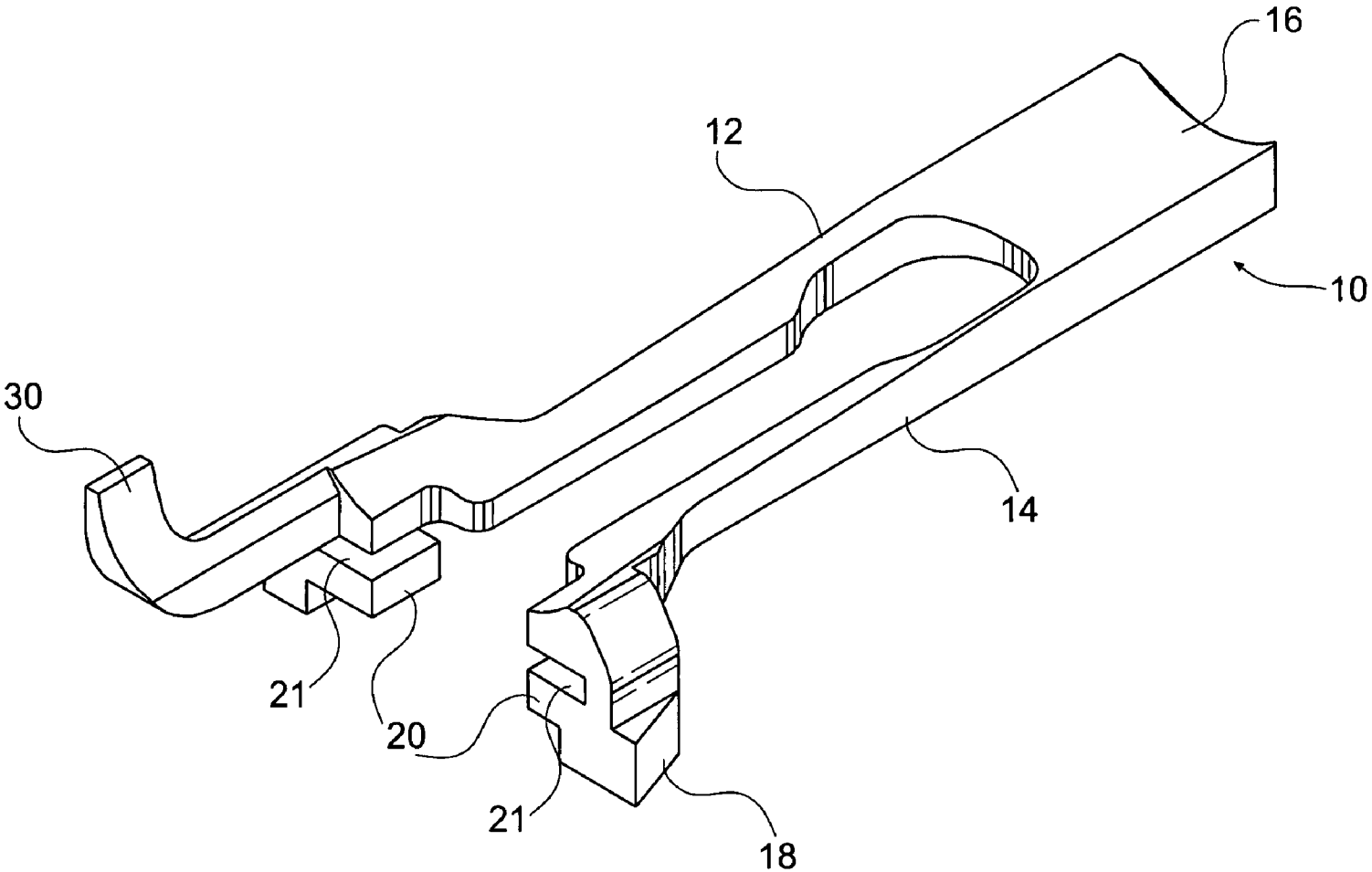
FIG. 2B is a rear perspective view of the shell stripper.

FIGS. 2A and 2B are perspective views of the shell stripper 10 of the shell stripper assembly 5 according to the first embodiment of the invention. The shell stripper 10 includes a body 11, typically formed from steel or similar high strength metal or other material, and having a first leg 12 and a second leg 14 joined at a front or nose portion 16. The first and second legs 12, 14 define a longitudinally extending clearance or slot 24 extending substantially along the body 11 of the shell stripper approximately in the center of the shell stripper 10, and having an enlarged first or forward end 26, a narrowed intermediate portion 27 and an outwardly flaring rear or second end 28. Stripper plate guide rails 20 generally extend inwardly from the rear or second end of the clearance 24 into the interior of the rear of the shell stripper 10, and define stripper plate guide grooves 21 that are sized to accommodate the stripper guide plate 60. A projection 30 extends rearwardly and upwardly from the rear or free end 31 of the first leg 12, with first and second tabs 18, 22 (shown in FIGS. 2A-2C) extending outwardly from the sides of the first and second legs 12, 14, respectively.

Referring to FIGS. 2C and 2F, the first and second legs 12, 14 of the shell stripper 10 generally are relatively flexible, and during feeding of a round of ammunition into the chamber of a firearm, the legs 12, 14 will tend to flex inwardly toward the round, generally at hinge points 32, 34. FIG. 2F illustrates the relatively narrow cross section of the hinged legs 12, 14 at the hinge points 32, 34 with each leg 12, 14 further including a respective inclined surface 13, 15 at its rear end 31. These inclined surfaces 13, 15 can act as camming surfaces by which the stripper guide 40 causes the first and second legs 12, 14 to flex inwardly, and typically are inclined or angled at an angle of inclination $\alpha$. The angle of inclination $\alpha$ of the inclined surfaces 13, 15, measured with respect to the long axis of the shell stripper 10, may be in a range of about 20-50 degrees, for example. Additionally, referring to FIGS. 2D and 2E, the shell stripper 10 has a top profile 36 that may be generally shaped to accommodate a bottom or lower surface of a breech bolt of the firearm. As shown in FIG. 2E, the top profile 36 generally includes widened arcuate surfaces 38 that may accommodate the bolt assembly when the first and second legs 12, 14 are in both a flexed and an unflexed condition.

Figure 3A:
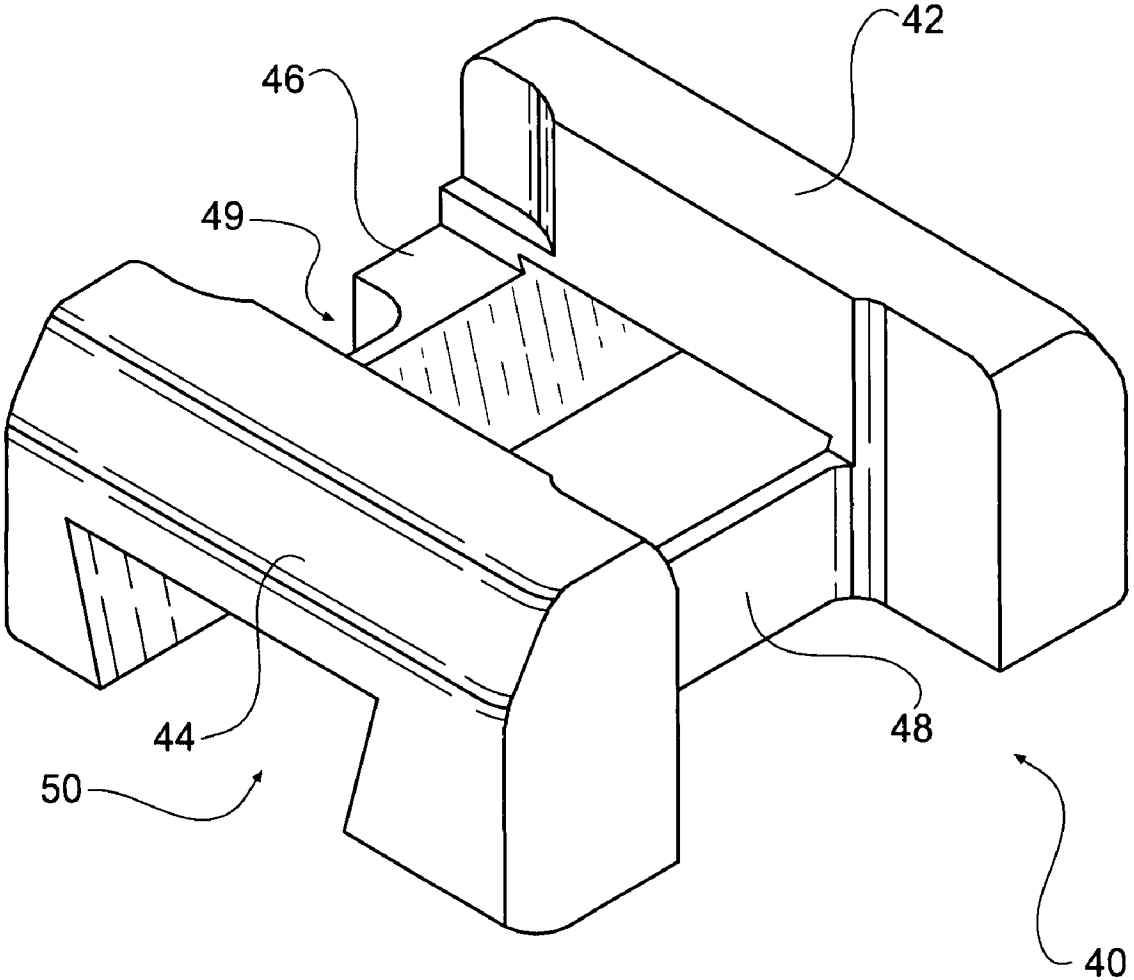
FIG. 3A is a perspective view of a stripper guide according to the first embodiment.
Figure 3D:
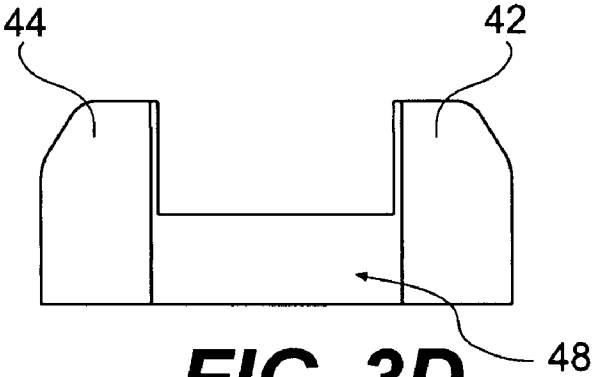
FIG. 3D is a front elevational view of the stripper guide.
Figure 3E:
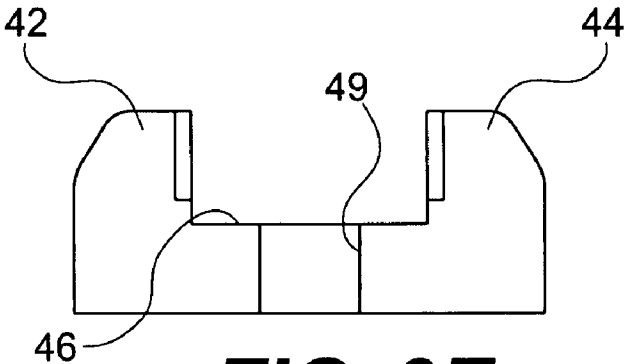
FIG. 3E is a rear elevational view of the stripper guide.
Figure 3B:
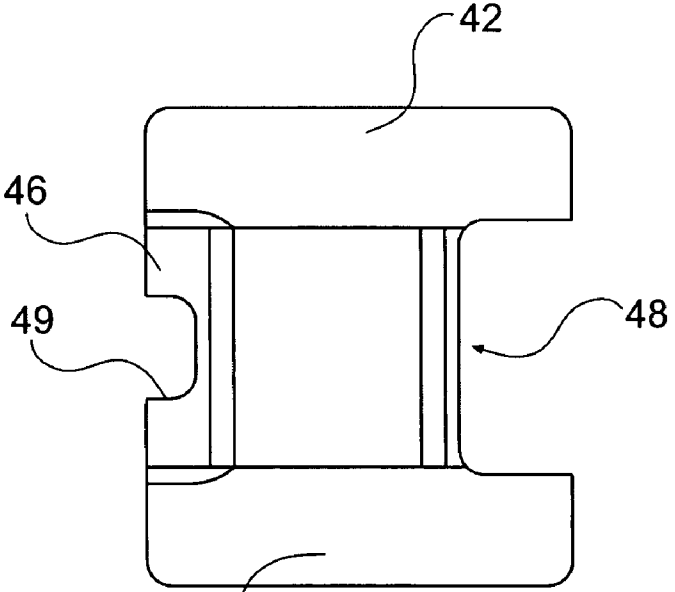
FIG. 3B is a top plan view of the stripper guide.
Figure 3C:
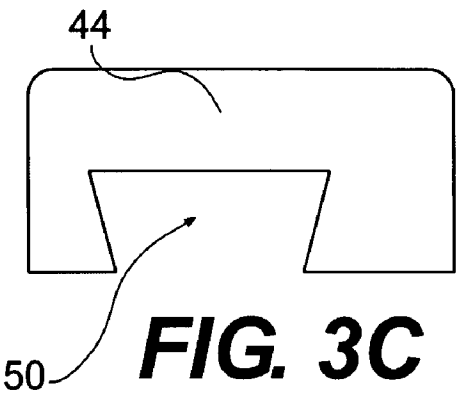
FIG. 3C is a left side elevational view of the stripper guide.

FIGS. 3A-3D illustrate the stripper guide 40 of the shell stripper assembly 5. The stripper guide 40 generally includes first and second guide rails 42, 44 that pinch or flex the legs 12, 14 of the shell stripper 10 together in order to disengage the shell stripper 10 from an action bar of a firearm during firing. Referring also to FIG. 3B, the stripper guide 40 generally includes a ledge 46 for supporting the stripper guide plate 60. A clearance 48 for the magazine box of a firearm is formed into a front portion of the stripper guide 40, while a hammer clearance 49 can be formed into a rear portion of the stripper guide 40 to allow the hammer of the firearm to move from a cocked position below the firearm breech bolt and to strike the firing pin of the firearm to fire the round of ammunition in the chamber of the firearm. Referring to FIG. 3C, a mounting groove 50 extends across the bottom of the stripper guide 40. The mounting groove 50 is shown here in a dovetail configuration, although other shapes also can be used, and is used to secure the stripper guide 40 to the magazine insert 80.

Figure 4:
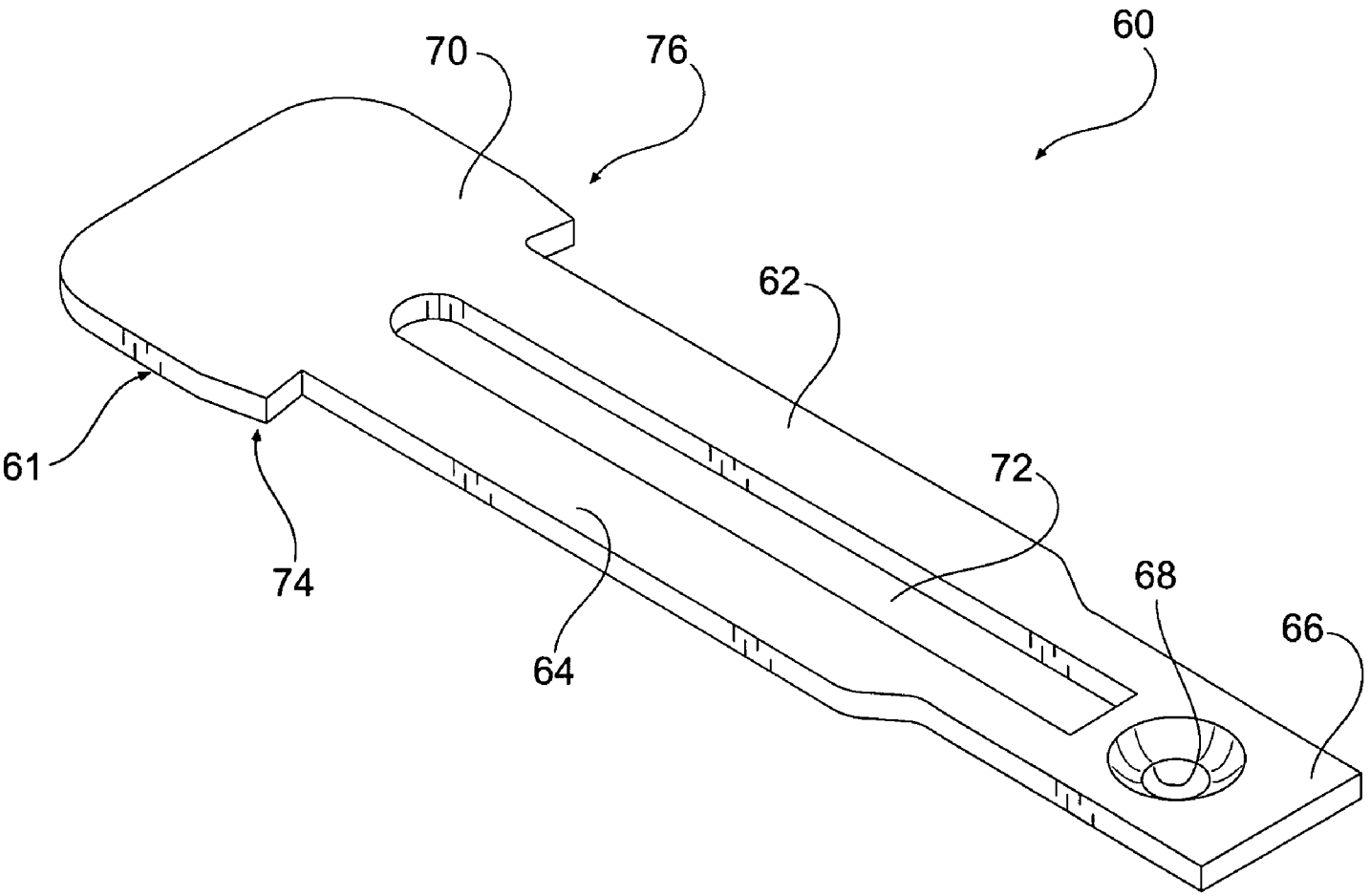
FIG. 4 is a perspective view of a stripper guide plate according to the first embodiment.

FIG. 4 illustrates the stripper guide plate 60 of the stripper assembly 5. The stripper guide plate 60 generally has a substantially flat body 61 formed from metal, such as a stamped steel, or a durable high strength composite material, and controls and guides movement of the shell stripper 10 as it cycles during firing. The stripper guide plate 60 includes a first leg 62 and a second leg 64 extending along a length of the guide plate 60. The first and second legs 62, 64 are joined at a front portion 66 and at a rear portion 70 of the body 61, defining a longitudinally extending slot 72 that extends between the legs 62, 64 and allows the hammer of the firearm to rise from beneath the stripper guide plate 60 to strike the firing pin. The front portion 66 may also include a countersunk bore 68 that accommodates a fastener 168 (shown in FIG. 7D) to secure the stripper guide plate 60 to the magazine insert 80. The first and second legs 62, 64 (FIG. 4) are sized to slide axially within the stripper plate guide rails 21 (shown in FIG. 2B). As further generally illustrated in FIG. 4, the width of the rear portion 70 of the plate body 61 is generally machined to correspond to an interior space or portion of an action bar for the firearm in which the shell stripper assembly of the present invention is used. The rear portion 70 of the plate body 61 also can include sloped or angled shoulders 74, 76 that act to help center the rear portion 70 within the action bar as the action bar moves rearwardly during the firing cycle.

FIGS. 5A-5D illustrate the magazine insert 80 for use with the shell stripper assembly 5 according to the present invention. The magazine insert 80 may be mounted within the receiver of a firearm and houses the magazine. The magazine insert 80 includes first and second parallel sidewalls 82, 84, a front wall 88, and a rear wall 90. A magazine latch clearance 86 can be formed in the second sidewall 84, while a dovetail mounting projection 92 extends across an upper rear portion of the magazine insert 80, and a threaded aperture 94 is provided in the mounting projection 92. The mounting projection 92 is sized and dimensioned to be received within the dovetail mounting groove 50 of the stripper guide 40, whereupon the aperture 94 will be positioned to receive the fastener 168 (FIG. 7D) that also extends through the bore 68 in the stripper guide plate 60 (FIG. 4). The fastener 168 also extends through the open central section of the stripper guide 40.

Figure 5A:
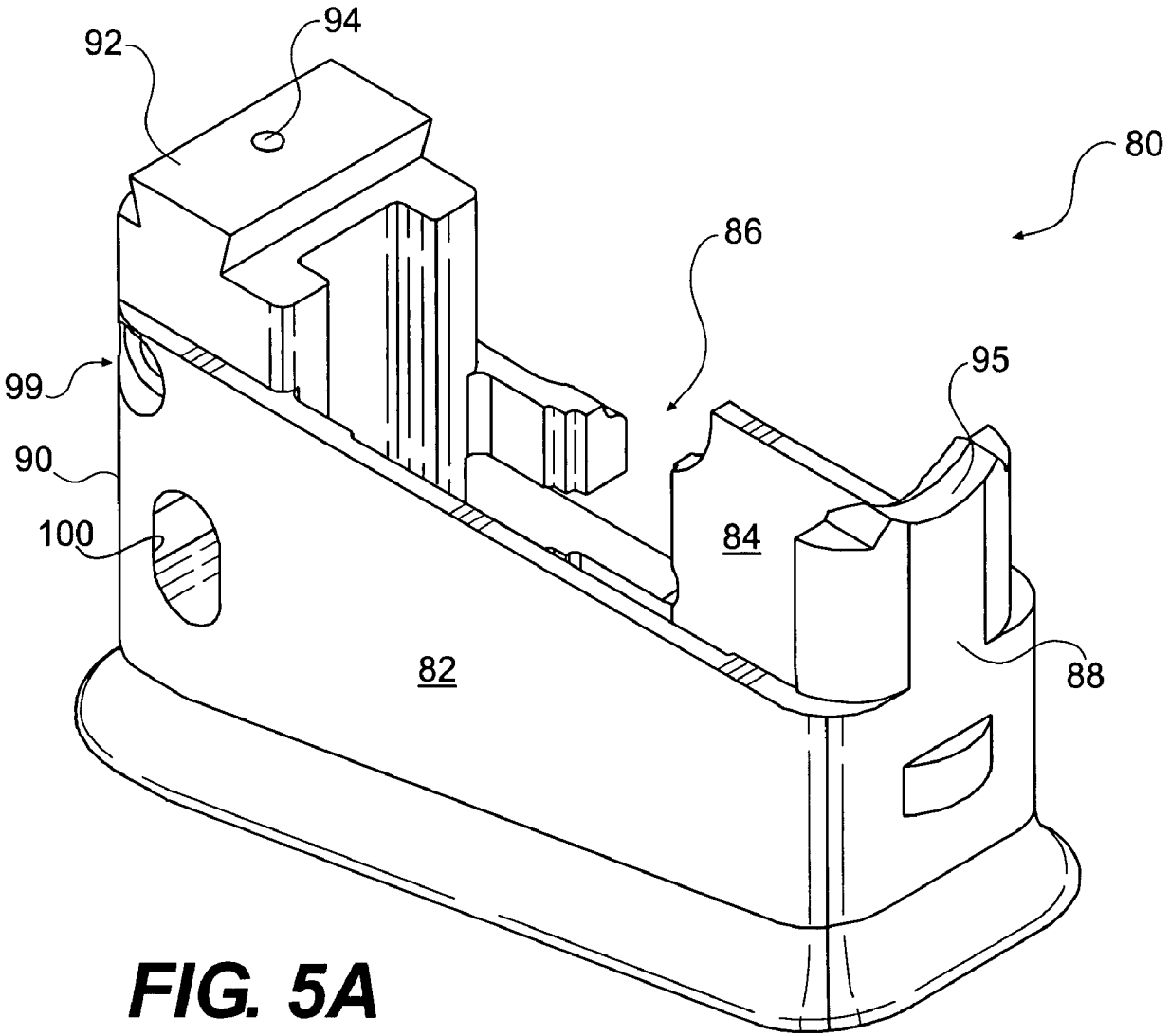
FIG. 5A is a perspective view of a magazine insert according to the first embodiment.
Figure 5B:
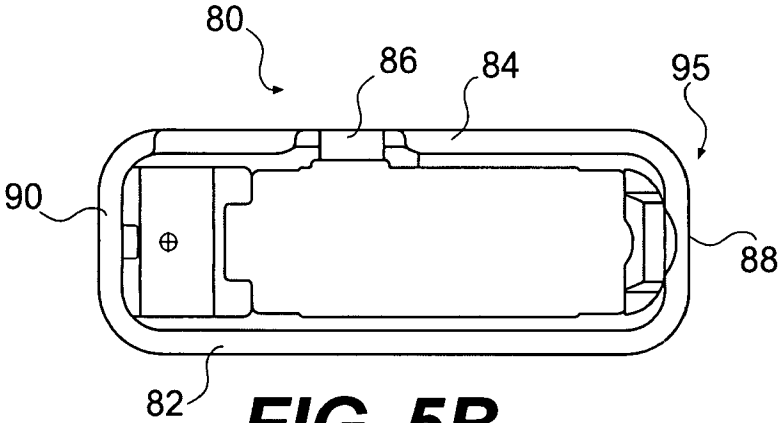
FIG. 5B is a top plan view of the magazine insert.
Figure 5C:
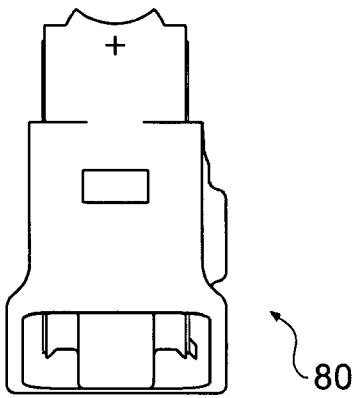
FIG. 5C is a front elevational view of the magazine insert.
Figure 5D:
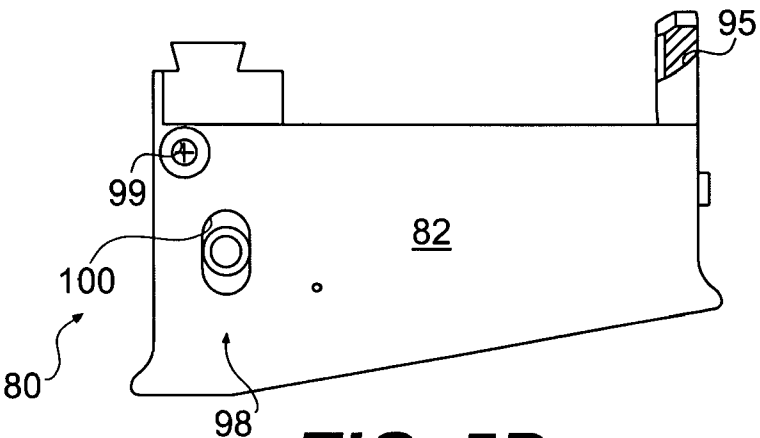
FIG. 5D is a side elevational view of the magazine insert.

As shown in FIG. 5A, a curved support surface 95 extends across the top of the front wall 88 of the magazine insert 80. The support surface 95 engages a recess in the firearm receiver for guiding the magazine insert 80 into and supporting the insert within the receiver of the firearm. Referring to FIG. 5D, a threaded aperture 99 is formed in the first sidewall 82, and is positioned to accommodate a threaded fastener 199 (shown in FIG. 7B) that secures the magazine insert 80 to the receiver of the firearm. In addition, a spring-loaded magazine release button 98 is disposed in a release button recess 100 in the first sidewall 82, for engaging a magazine latching assembly. The magazine latching assembly can be, for example, conventional in construction, and enables disengagement of a magazine from the magazine well of a firearm.

Figure 6:
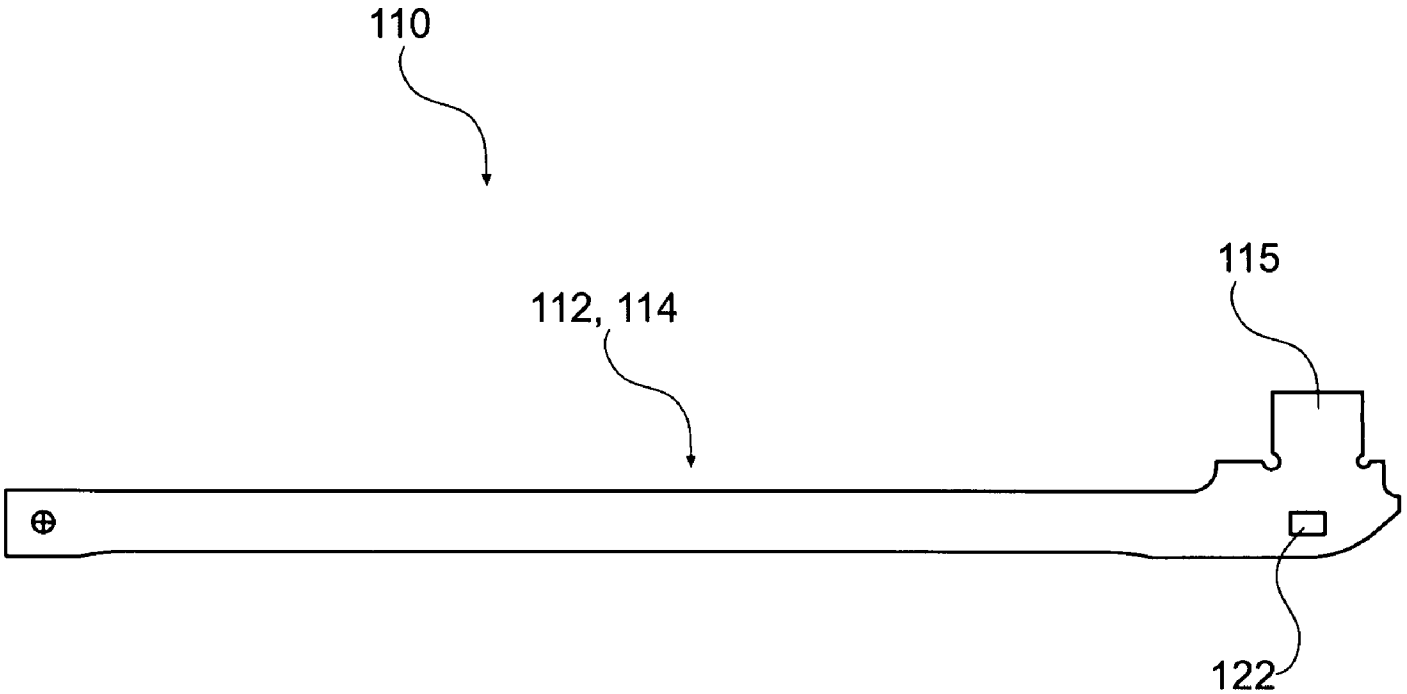
FIG. 6 is a side elevational view of an action bar for use in a firearm having a shell stripper assembly.

FIG. 6 is a side elevational view of an action bar 110 of a firearm for use with the stripper assembly 5 of the present invention. The action bar 110 is the action mechanism which guides the movement of the breech bolt during opening and closing of the firearm action. The action bar 110 includes first and second elongated rails 112, 114 (shown in FIG. 7A), which are joined at an archlike rear portion 115. The action bar 110 includes first and second apertures 118 (FIG. 7B), 122 (FIG. 7A) beneath the rear portion 115. The apertures 118, 122 may be in the form of, for example, rectangular slots, and generally are sized to receive and to releasably engage with the first and second tabs 18, 22 on the shell stripper 10. Other configurations and sizes of the apertures 118, 122, such as partially arcuate slots, also can be used.

FIGS. 7A-7F illustrate the operation of the shell stripper assembly 5 in a partially exploded view of a firearm 200 during a firing cycle. During the firing cycle, the shell stripper assembly 5 acts as a feeding mechanism for stripping the top round from a magazine so that it can be picked up by the breech bolt and seated into the chamber of the firearm 200. The firearm may be, for example, a gas actuated or semiautomatic long gun or handgun, a pump action shotgun, a gas actuated rifle, an inertia action firearm, a bolt action firearm, or other type of firearm. The exemplary firearm 200 illustrated in FIGS. 7A-7F operates by pump action.

Figure 7A:
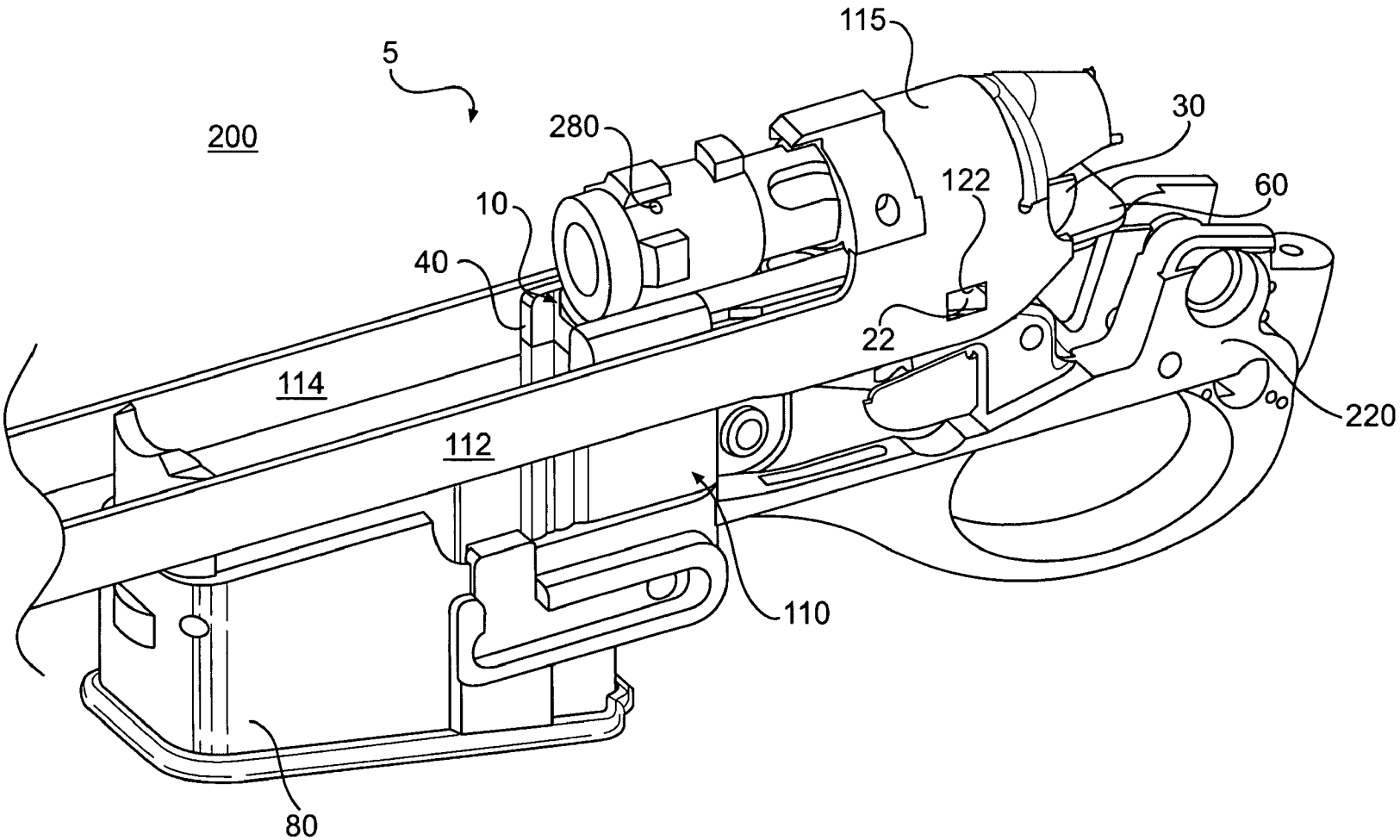
FIGS. 7A-7F illustrate the operation of the shell stripper assembly during a firing cycle.

FIG. 7A illustrates a portion of the firearm 200 with the action fully open. The firearm 200 is equipped with the shell stripper assembly 5 arranged in operable engagement with the action bar 110, a breech bolt 280, and a trigger plate assembly 220. The breech bolt 280 generally rests on the top profile 36 of the shell stripper 10 (shown in FIGS. 2D and 2E), which is mounted between the first and second guide rails 42, 44 of the stripper guide 40. The stripper guide plate 60 is secured to the magazine insert 80 by a fastener 168 (shown in FIG. 7D), with the first and second legs 62, 64 of the stripper guide plate 60 being received within the stripper guide plate grooves 21 at the rear of the shell stripper 10.

With the action fully open, the breech bolt 280 is in its rearward most position. In this position, the first and second tabs 18, 22 of the shell stripper 10 are engaged with and temporarily locked in position in the first and second slots 118, 122 of the action bar 110, and with the rear of the breech bolt 280 received within the archlike portion 115 at the rear of the action bar 110. The projection 30 located at the rear of the shell stripper 10 abuts the rear of the breech bolt 280.

Figure 7B:
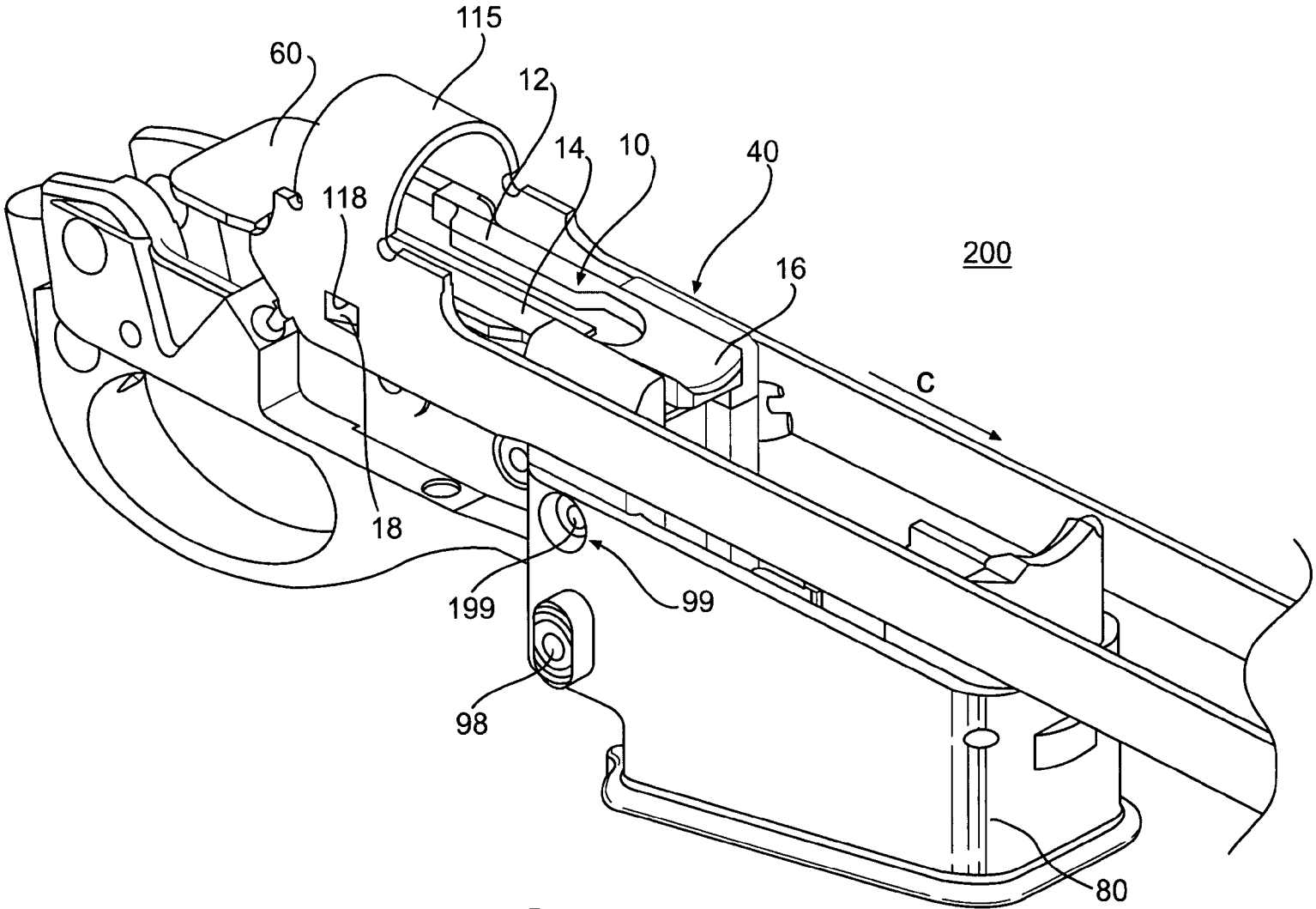

FIG. 7B illustrates a portion of the firearm 200 with the action closing, with the closing movement of the action bar 110, breech bolt and the shell stripper 10 generally being illustrated by arrow C. The breech bolt 280 is not shown in FIG. 7B in order to more clearly illustrate the operation of the shell stripper assembly 5. The stripper guide 40, stripper guide plate 60, and magazine insert 80 may be, for example, constructed to remain fixed in position during operation of the firearm 200. In FIG. 7B, the action bar 110 is shown fully engaged and pushing the shell stripper 10 forward through the engagement of the first and second slots 118, 122 in the action bar 110 with the first and second tabs 18, 22 on the shell stripper 10. The first and second legs 12, 14 of the shell stripper 10 are not flexed inwardly at this point, and the tabs 18, 22 therefore remain in engagement with their respective slots 118, 122. In operation, a loaded magazine (not shown) would be placed in the firearm 200, with an uppermost round of ammunition within the magazine proximate to the front portion 16 of the shell stripper 10. As the shell stripper 10 moves forwardly along with the action bar 110, the front portion 16 of the shell stripper 10 engages a rear portion or rim of the round and pushes it forward, lifting the round out of the magazine and urging the round into a position where it can be engaged and picked up by the breech bolt 280.

FIG. 7B also illustrates the engagement of the fastener 199 received in the threaded aperture 99 in the magazine insert 80. The fastener 199 may, for example, extend through the firearm receiver and into the threaded aperture 99 to secure the magazine insert 80 to the receiver. Other fastening arrangements also may be used.

Figure 7C:
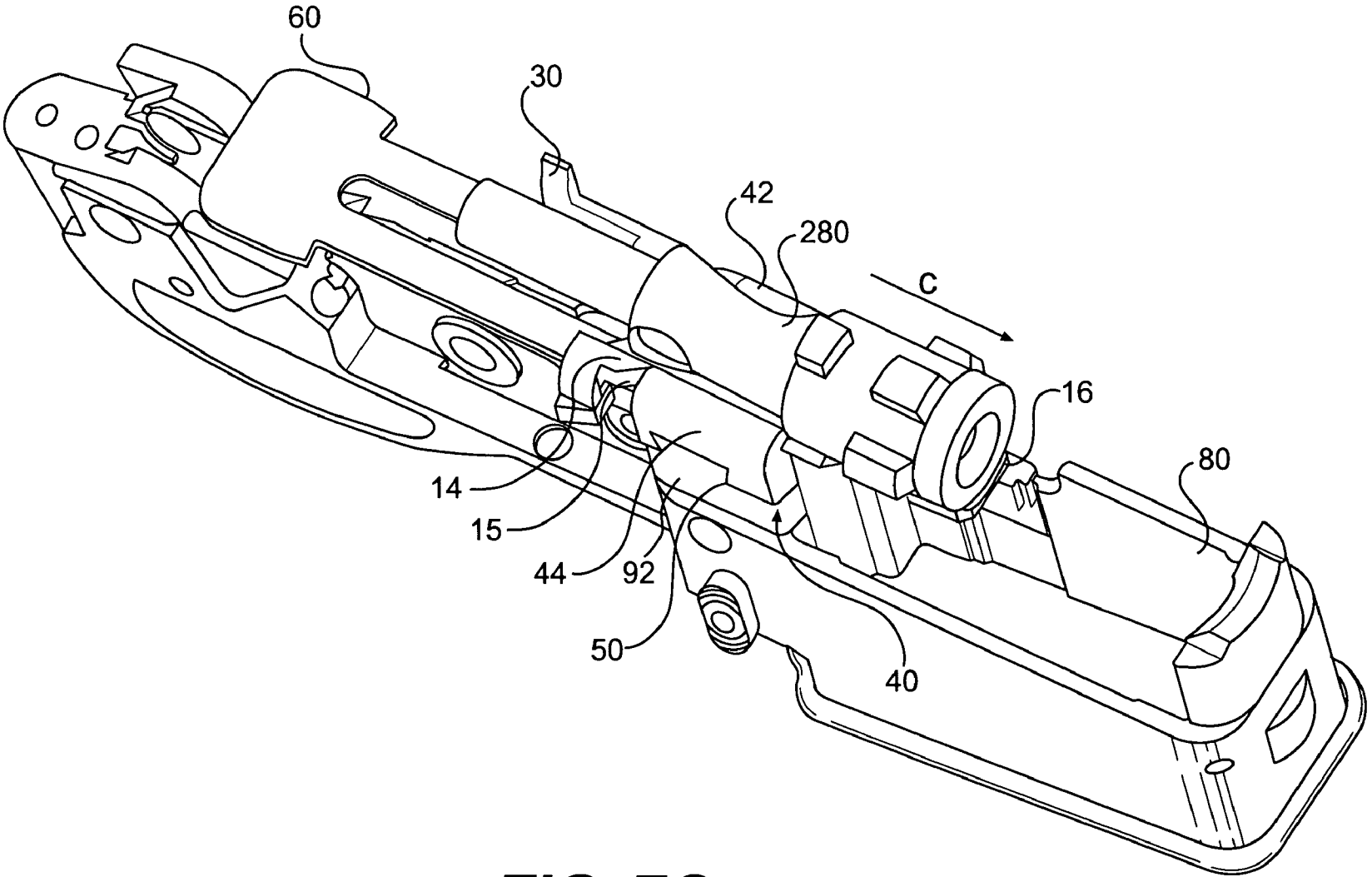

FIG. 7C illustrates a portion of the firearm 200 with the action being further closed in the direction of the arrow C. In FIG. 7C, the action bar 110 is not shown, however, in order to better illustrate the closing action. At this point, the first and second inclined surfaces 13, 15 (surface 13 is not visible in FIG. 7C) at the rear of each of the respective legs 12, 14 of the shell stripper 10 engage a respective one of the first and second guide rails 42, 44 of the stripper guide 40, which flexes the first and second legs 12, 14 inwardly at the hinge points 32, 34 (FIG. 2C). The inward flexing of the legs 12, 14 in turn causes the first and second tabs 18, 22 to be disengaged from their respective slots 118, 122 in the action bar 110 (not shown), which accordingly partially or wholly decouples the motion of the action bar 110 from the shell stripper 10. As further shown in FIG. 7C, the dovetail mounting projection 92 of the magazine insert 80 is received within the dovetail mounting recess 50 of the stripper guide 40.

Figure 7D:
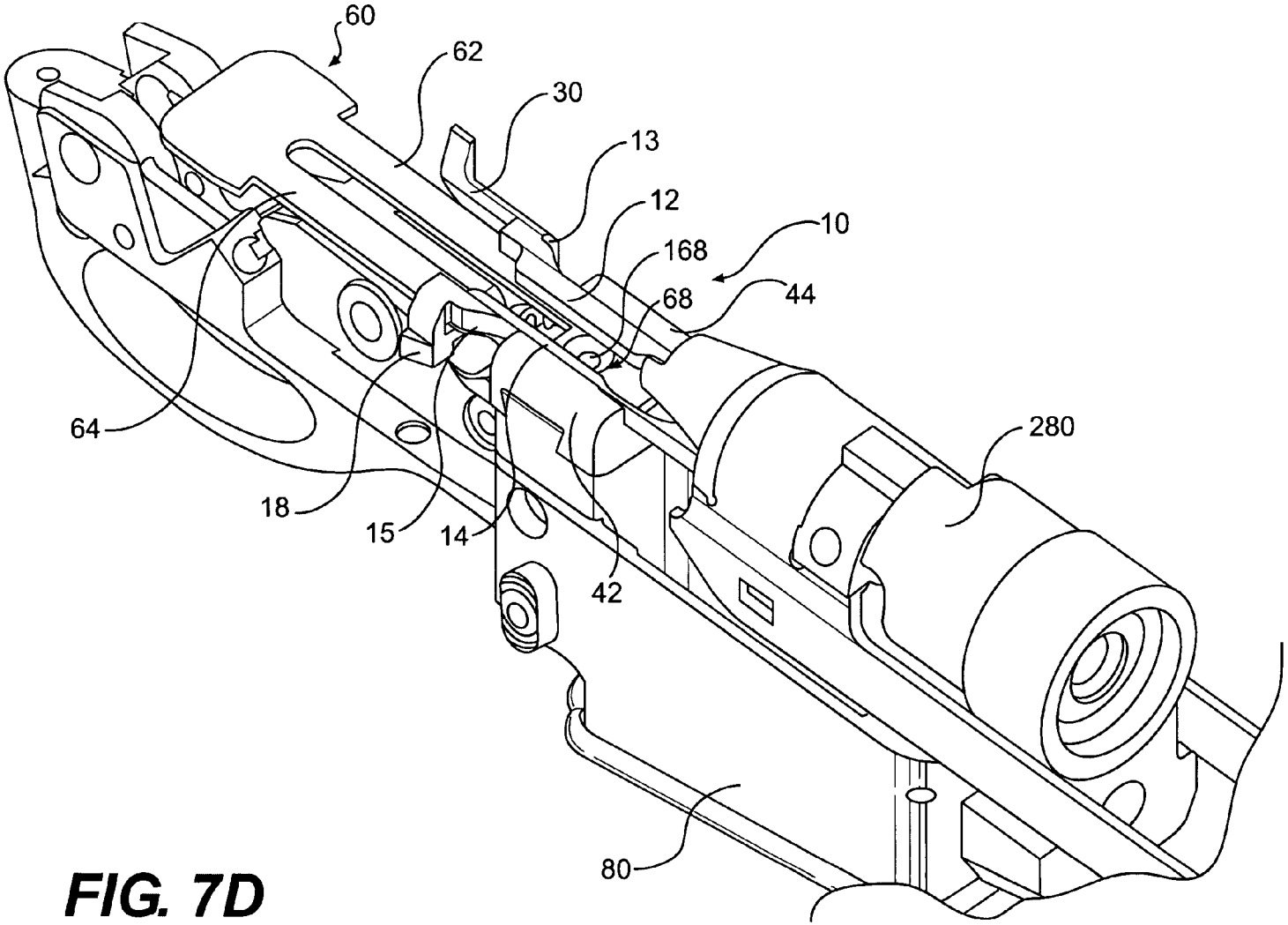

FIG. 7D illustrates a portion of the firearm 200 with the action closed, at which point the breech bolt 280 in its forward most position. At this point, the breech bolt 280 has urged the shell into the chamber of the firearm 200 and the breech bolt 280 is in a closed and locked position and ready for firing. The legs 12, 14 of the shell stripper 10 are also partially unflexed as the inclined surfaces 13, 15 on the legs 12, 14 disengage the guide rails 42, 44 of the stripper guide 40.

FIG. 7D also illustrates the threaded fastener 168 extending through the countersunk bore 68 in the stripper guide plate 60. The fastener 168 may, for example, extend through the countersunk bore 68 and into the threaded aperture 94 in the magazine insert 80 to secure the stripper guide plate 60 to the magazine insert 80. Other fastening arrangements also may be used.

Figure 7E:
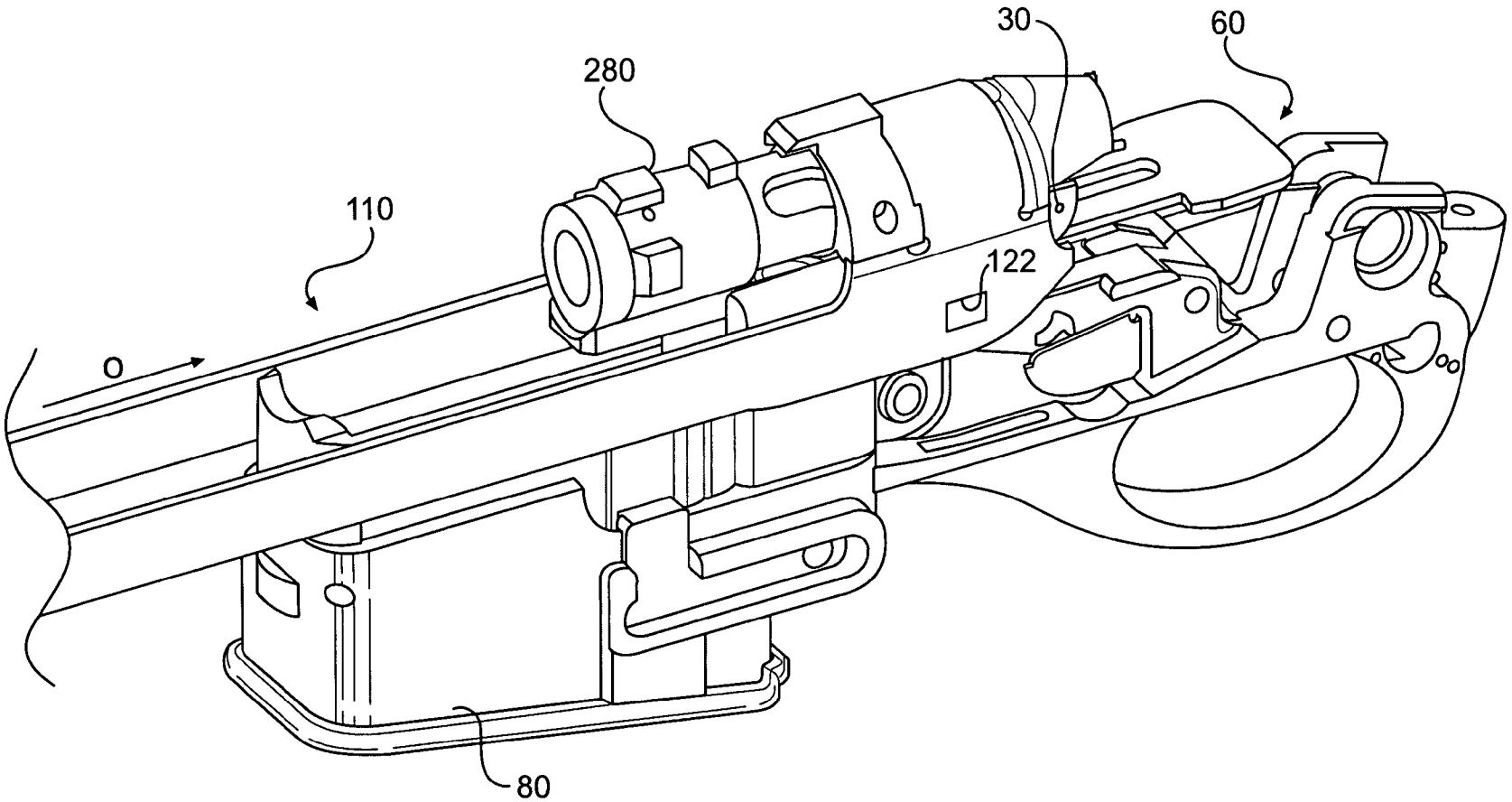

FIG. 7E illustrates a portion of the firearm 200 after firing, with the action moving to an opened position. The opening motion of the action is indicated by the arrow O. As the action bar 110 moves rearwardly, a rear portion of the action bar 110 engages the upstanding projection 30 of leg 12 of the shell stripper 10, thereby forcing the shell stripper 10 to also move rearwardly. As the shell stripper 10 moves rearwardly relative to the stripper guide 40, the first and second inclined surfaces 13, 15 of the shell stripper 10 move out of engagement with the first and second guide rails 42, 44, as the first and second legs 12, 14 are flexed outwardly. The first and second tabs 18, 22 are therefore in position to re-engage with their respective slots 118, 122. As the action bar 110 is moved further rearwardly so as to open the chamber of the firearm 200, the spent casing of the previously fired round of ammunition is ejected and a new round of ammunition is urged upwardly to the top of the magazine.

Figure 7F:
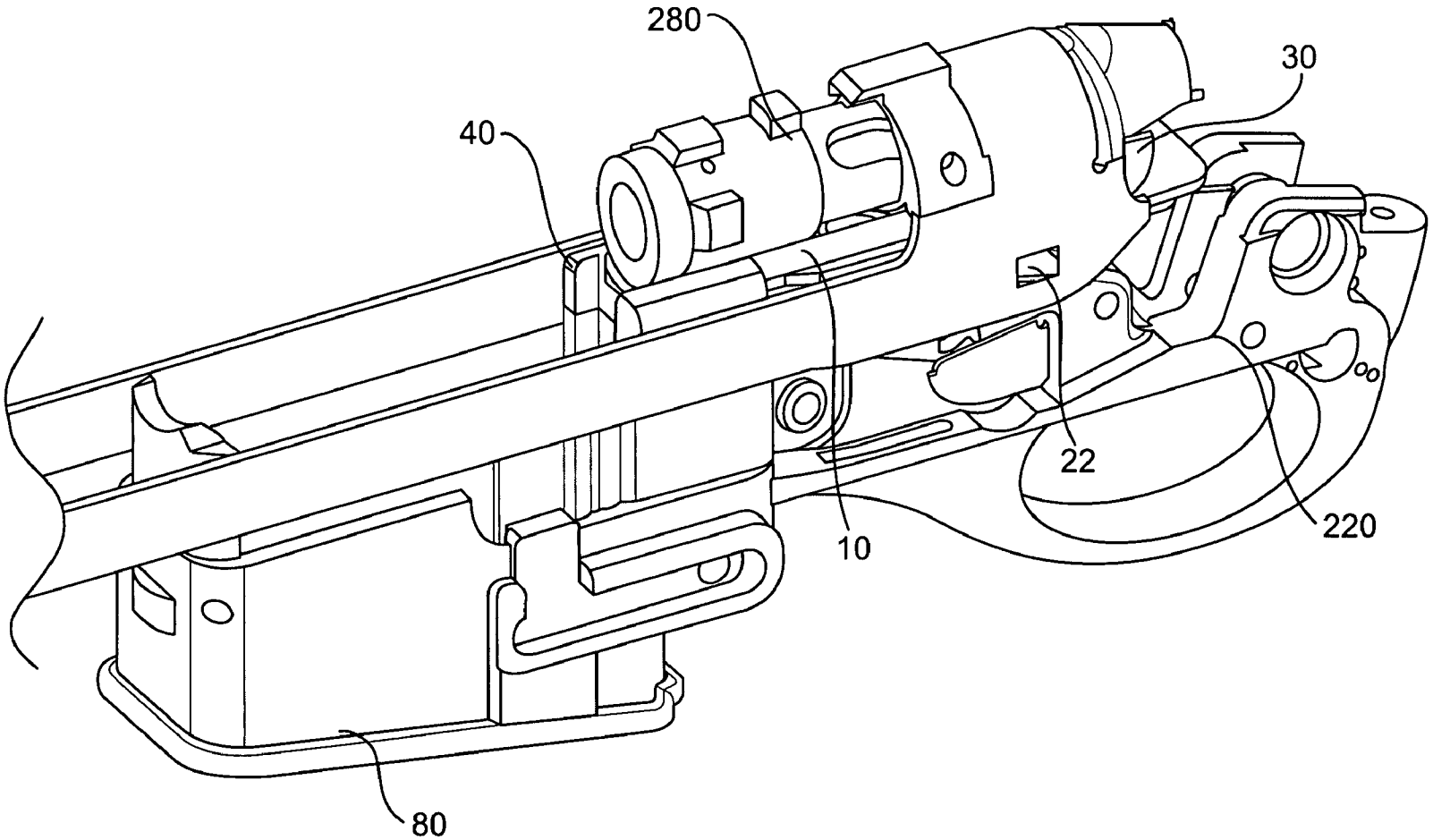

FIG. 7F illustrates a portion of the firearm 200 with the action returned to the fully opened configuration. The firearm 200 is now in the state shown in FIG. 7A, and is in position for loading another round into the chamber of the firearm 200. In this position, the tabs 18, 22 of the shell stripper 10 are again engaged with their respective slots 118, 122 of the action bar 110 to couple the motion of the action bar 110 with the stripper 10, so that forward movement of the action bar 110 also drives the shell stripper 10 forward.

Figure 8:
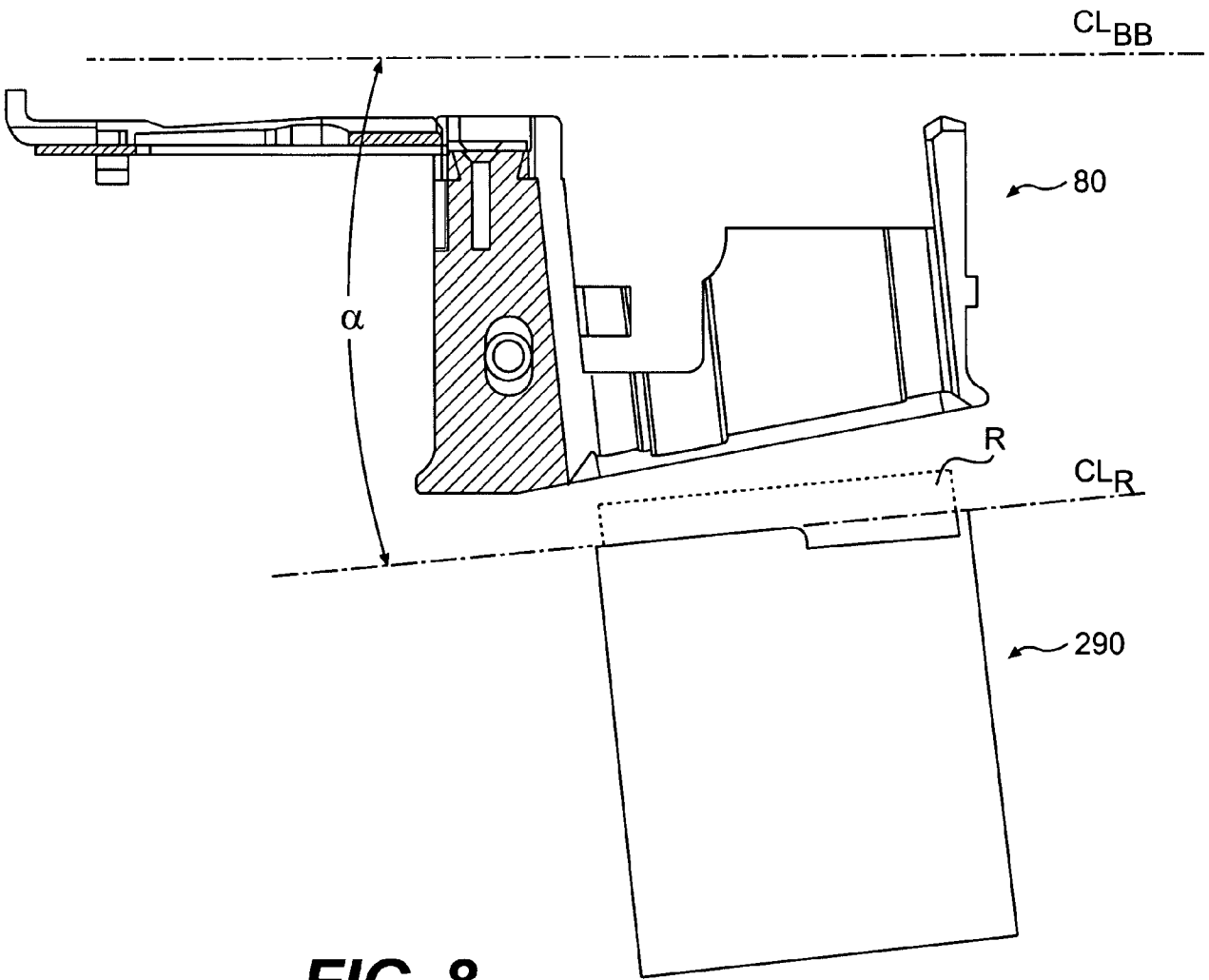
FIG. 8 illustrates the angle of inclination at which the magazine insert places a firearm.

FIG. 8 illustrates a magazine 290 in a position for insertion into the magazine insert 80. Once the magazine 290 is inserted in the magazine insert 80, the magazine insert 80 supports the magazine 290 such that a top round in the magazine is tilted at angle of inclination $\gamma$. The angle of inclination $\gamma$ places the top round R in the magazine 290 at an angle such that the top or uppermost round is more easily stripped from the magazine 290 and picked up by the breech bolt 280. The angle of inclination $\gamma$ may be defined in relation to the axis or path that the breech bolt 280 travels as it translates above the magazine 290. This path is indicated by $CL_{BB}$ in FIG. 8. The axis of the top round R is indicated by CLR. The angle of inclination γ can be in the range of about, for example, 2-10 degrees. In certain embodiments, the angle γ can be in the range of about 3-8 degrees. In yet another embodiment, the angle γ is about 5 degrees.

According to the above embodiments, rounds are generally more reliably stripped from the firearm magazine by the shell stripper of the present invention. The use of the shell stripper to strip rounds from the magazine thus reduces or potentially eliminates the need for the breech bolt to strip rounds from the magazine, and consequently, the breech bolt diameter may be minimized as a determining factor in the size or shape of the magazine or the magazine well.

According to the above embodiments, the shell stripper can have an engagement surface that is adapted to efficiently and reliably engage a round in the magazine. By contrast, in conventional firearms, the breech bolt generally must be designed to seal the chamber during firing as well as to strip rounds from the magazine. The dual design requirements for conventional breech bolts may compromise the ability of the breech bolt to strip rounds from the magazine. For example, if the breech bolt is large, only a small portion of the lower part of the breech bolt is available to reach down into the magazine well to engage the top round in the magazine.

The shell stripper assembly also allows various types of magazines to be used in the firearms in which the shell stripper assembly is used. For example, relatively narrow magazines can be accommodated in firearms equipped with shell stripper assemblies according to the above embodiments. By contrast, when the bolt assembly is required to strip a round from a magazine, as in conventional firearms, the opening in the magazine must be wide enough to allow the cylindrical bolt face to reach down into the magazine to strip the top round from the magazine.

Also, according to the above embodiments, the bolt assembly 280 may have a smooth, arcuate bottom and does not require rails on its undersurface, as do conventional bolt assemblies.

In alternative embodiments, the projection 30 on the shell stripper 10 may be omitted. In this case, the shell stripper 10 may be designed such that friction between the first and second tabs 18, 22 and their respective slots 118, 122 is sufficient to move, or "reset" the shell stripper 10.

The components of the shell stripper assembly 5 can be made from, for example, conventional durable, high strength materials including metals, such as hardened steel, composites, and other materials.

The example embodiment of the shell stripper assembly 5 within a firearm illustrated in FIGS. 7A-7F is shown as being operated by pump action, however, the shell stripper assembly 5 also may, in alternative embodiments, be adapted for use in other types of firearms such as, for example, a semiautomatic gas-actuated firearm. In such an embodiment, the gas-actuated firearm will divert a portion of the ignition or combustion gases generated by firing rearwardly so as to drive the action bar or sleeve and breech bolt of the firearm rearwardly, which accordingly opens the chamber or action and resets the bolt and sear of the firearm to a ready to fire position. Other types of firearms may be equipped with a shell stripper assembly as discussed herein without departing from the scope of the present invention.

The foregoing description of the invention illustrates and describes the present invention. Additionally, the disclosure shows and describes only selected embodiments of the invention, but it is to be understood that the invention is capable of use in various other combinations, modifications, and environments and is capable of changes or modifications within the scope of the inventive concept as expressed herein, commensurate with the above teachings, and/or within the skill or knowledge of the relevant art.

What is claimed is:

1. A firearm, including a shell stripper assembly, the shell stripper assembly comprising:
- a shell stripper comprising a first elongate leg and a second elongate leg spaced from said first leg, and a first tab extending from said first leg;
- a stripper guide comprising a first guide rail and a second guide rail, said shell stripper being sized to be received between said first and second guide rails;
- a stripper guide plate adapted to be received between the shell stripper and the stripper guide; and
- a magazine insert adapted to support a magazine therein, wherein said firearm further comprises:
  - a receiver;
  - a barrel operably connected to said receiver;
  - a chamber disposed at a rear end of said barrel;
  - a magazine disposed to the rear of said chamber in said magazine insert;
  - an axially translatable breech bolt that is engageable with said chamber; and
  - an action mechanism extending along a length of said firearm and axially translatable along with said breech bolt, wherein
  - said shell stripper is mounted within said firearm to cooperate with said action mechanism to strip rounds from said magazine, and
  - said stripper guide plate is fixedly mounted in the firearm and in slidable engagement with said shell stripper.

2. The firearm of claim 1, wherein said shell stripper further comprises:
- a second tab extending from a rear portion of said second leg.

3. The firearm of claim 1, wherein said shell stripper further comprises:
- a first guide groove;
- a second guide groove; and
- wherein said stripper guide plate is sized to be received and to slidably translate within said first and second guide grooves.

4. The firearm of claim 3, wherein said shell stripper further comprises:
- at least one projection extending from a rear portion of said first leg.

5. The firearm of claim 1, wherein said first leg comprises a hinge portion.

6. The firearm of claim 1, wherein said stripper guide further comprises:
- a magazine box clearance formed in a front of said stripper guide.

7. The firearm of claim 1, wherein said stripper guide further comprises:
- a hammer clearance formed in a rear portion of said stripper guide.

8. The firearm of claim 1, wherein said stripper guide further comprises:
- first mounting means along an underside portion of said stripper guide.

9. The firearm of claim 8, wherein said magazine insert comprises:
- second mounting means at an upper portion of said magazine insert designed to engage said first mounting means in said stripper guide.

10. The firearm of claim 9, wherein said magazine insert further comprises:

first, second, third, and fourth walls defining a magazine receiving slot; and a magazine latch clearance formed in said second wall.

11. The firearm of claim 1, wherein said stripper guide plate comprises:

a hammer clearance aperture extending along an intermediate section of said stripper guide plate.

12. The firearm of claim 11, wherein said stripper guide plate comprises:

a rear portion having inclined shoulders.

13. The firearm of claim 1, wherein said shell stripper is slidably mounted in said stripper guide.

14. The firearm of claim 13, wherein said magazine is mounted within said magazine insert below said breech bolt.

15. The firearm of claim 13, wherein said breech bolt is slidable over an upper surface of said shell stripper.

16. A firearm, comprising:

a barrel;

a chamber disposed at a rear end of said barrel;

a magazine disposed adjacent said chamber;

an action mechanism axially translatable along a length of said firearm;

a shell stripper assembly mounted within said firearm and adapted to cooperate with said action mechanism and to strip rounds from said magazine; and an axially translatable breech bolt cooperating with said action mechanism and said shell stripper assembly and engageable with said chamber, wherein said shell stripper assembly comprises:

a shell stripper that is releasably engageable with said action mechanism and is movable with said action mechanism, said shell stripper having an engagement surface adapted to engage a round of ammunition within said magazine;

a stripper guide fixedly mounted within said firearm, wherein said shell stripper is slidably mounted within said stripper guide and wherein said breech bolt rests on an upper surface of said shell stripper.

17. The firearm of claim 16, wherein said shell stripper further comprises a first elongate leg and a second elongate leg joined at a nose portion, said engagement surface being disposed at said nose portion.

18. The firearm of claim 16, wherein said stripper guide comprises:

a first guide rail and a second guide rail, said shell stripper being slidably mounted between said first and second guide rails.

19. The firearm of claim 18, wherein said stripper guide further comprises:

a magazine box clearance formed in a front of said stripper guide; and a hammer clearance formed in a rear of said stripper guide.

20. The firearm of claim 16, wherein said shell stripper assembly further comprises:

a stripper guide plate fixedly mounted in said firearm and in slidable engagement with said shell stripper.

21. The firearm of claim 20, wherein said shell stripper further comprises:

a first guide groove; and a second guide groove, wherein said stripper guide plate is slidably received within said first and second guide grooves.

22. The firearm of claim 21, further comprising a hammer, wherein said stripper guide plate comprises:

a hammer clearance aperture extending along an intermediate section of said stripper guide plate, the hammer being movable through the hammer clearance aperture; and a rear portion having inclined shoulders.

23. The firearm of claim 16, further comprising:

a magazine insert mounted below said breech bolt and housing said magazine, wherein said magazine insert comprises first, second, third, and fourth walls defining a magazine receiving slot.

24. The firearm of claim 23, wherein said magazine insert supports said magazine such that a top round in said magazine is oriented at a non-zero angle with respect to an axis of said breech bolt.

25. The firearm of claim 24, wherein said non-zero angle is in a range of about 2-10 degrees.

26. The firearm of claim 23, wherein said magazine insert further comprises mounting means at an upper portion of said magazine insert designed to engage mounting means in said stripper guide.

27. A firearm, comprising:

a barrel;

a chamber disposed at a rear of said barrel;

a magazine disposed adjacent said chamber;

an action mechanism axially translatable along a length of said firearm;

a shell stripper assembly adapted to cooperate with said action mechanism and to strip rounds from said magazine, said shell stripper assembly comprising:

a shell stripper that is releasably engageable with said action mechanism and is movable with said action mechanism; and a stripper guide, said shell stripper being slidably mounted in said stripper guide;

a translatable breech bolt cooperating with said action mechanism and said shell stripper and engageable with said chamber; and a stripper guide plate fixedly mounted in said firearm between said shell stripper and said stripper guide and in slidable engagement with said shell stripper.

28. The firearm of claim 27, further comprising a hammer, wherein said stripper guide plate comprises a hammer clearance aperture extending along an intermediate section of said stripper guide plate, said hammer being mounted for movement through said hammer clearance.

29. The firearm of claim 27, wherein said breech bolt is slidable over an upper surface of said shell stripper.

* * * * *